US005649846A

United States Patent [19]

Harper et al.

[11] Patent Number: 5,649,846

[45] Date of Patent: Jul. 22, 1997

[54] PIVOTABLE FIN SYSTEM

[76] Inventors: Derek Harper, P.O. Box 8, Billinudgel, N.S.W. Australia, 2483; Graeme Davey, P.O. Box 694; Fred Banyard, P.O. Box 530, both of Avalon, N.S.W., Australia, 2107; Jim Banks, 19 Albany Ave, Currumbin, Australia, 4223

[21] Appl. No.: 626,990

[22] Filed: Apr. 3, 1996

[51] Int. Cl.[6] ..... B63B 3/38

[52] U.S. Cl. ..... 441/79; 114/127

[58] Field of Search ..... 441/74, 79, 126, 441/127, 140; 114/127–143

[56] References Cited

U.S. PATENT DOCUMENTS

| | | | |
|---|---|---|---|
| 4,236,476 | 12/1980 | Solf et al. | 441/74 |
| 4,331,094 | 5/1982 | Drexler | 441/74 |
| 4,398,485 | 8/1983 | Diziere | 441/79 |
| 5,176,096 | 1/1993 | Molnar et al. | 441/79 |

FOREIGN PATENT DOCUMENTS

| | | | |
|---|---|---|---|
| 3031602 | 4/1982 | Germany | 441/74 |

*Primary Examiner*—Stephen Avila
*Attorney, Agent, or Firm*—Goldstein & Associates

[57] ABSTRACT

A pivotable fin system, for use with an aquafoil such as a surfboard, comprising a plug and a fin having a main portion and a tab. The plug mounts in the surfboard, and has a central slot for receiving the tab. The tab has a reverse taper that matches a reverse taper in the central slot. The tab has at least one vertical slot which compresses to allow the tab to be mounted in the central slot, the vertical slot expanding once the tab is fully inserted into the central slot, the tab then securely held in place by the matching reverse tapers of central slot and tab. The tab has at least one tab cut for allowing the main portion of the fin to pivot with respect to the tab, allowing the main portion of the fin to self-align to a position where it reduces drag and cavitation.

6 Claims, 6 Drawing Sheets

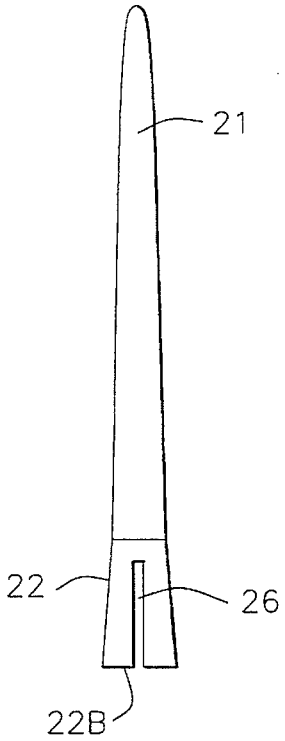
FIG. 4D
FIG. 4G
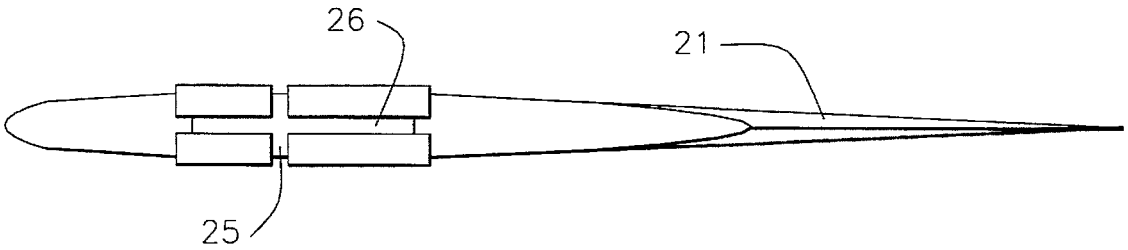

PIVOTABLE FIN SYSTEM

BACKGROUND OF THE INVENTION

1. Field of the Invention

The invention relates to a pivotable fin. More particularly, the invention relates to a self-aligning, pivotable or swivellable fin for a surfboard or similar aquafoil.

2. Background and Prior Art

Today, most modern surfboards and the like generally involve one or more rigid fins, protruding downward near the rear of the surfboard. The fins allow the rider to exercise greater control over speed and direction of the board.

Throughout the years, it has been the accepted practice that the fin or fins are permanently and rigidly attached to the surfboard. The rigidity of these prior art stationary fins creates a phenomenon known as drag or cavitation when the rigid fin encounters pressure as the board is turning. The cavitation is created by a turbulent build up of air bubbles on the back or lee side of the fin or fins, which in turn creates drag.

While these units may be suitable for the particular purpose employed, or for general use, they would not be as suitable for the purposes of the present invention as disclosed hereafter.

SUMMARY OF THE INVENTION

It is an object of the invention to produce a surfboard having a pivotable fin which is capable of adjusting its angle according to pressure exerted thereon. The fin is self-aligning, wherein it automatically returns to the optimum position of minimized pressure.

It is another object of the invention that the fin may be used with other equipment suitable for movement across the water fitting the general term "aquafoil", such as a sailboard, boogie board, or the like.

It is a further object of the invention that the fin is releasably attachable to the surfboard. The fin may be therefore removed and replaced with another fin more suitable for the prevailing wave conditions, such as by having varying degrees of pivotability.

It is a still further object of the invention that the fin may only be removed by a pulling force perpendicular to the surfboard, a force not normally encountered by the surfboard during use. Thus, the fin can be easily removed when desired, but cannot accidentally free itself from the surfboard during use.

The invention is a pivotable fin system, for use with an aquafoil such as a surfboard, comprising a plug and a fin having a main portion and a tab. The plug mounts in the surfboard, and has a central slot for receiving the tab. The tab has a reverse taper that matches a reverse taper in the central slot. The tab has at least one vertical slot which compresses to allow the tab to be mounted in the central slot, the vertical slot expanding once the tab is fully inserted into the central slot, the tab then securely held in place by the matching reverse tapers of central slot and tab. The tab has at least one tab cut for allowing the main portion of the fin to pivot with respect to the tab, allowing the main portion of the fin to self-align to a position where it reduces drag and cavitation.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

FIG. 4D is a front elevational view of the fin illustrated in FIGS. 4A–4C, showing a tab portion of the fin.

FIG. 4G is a bottom plan view of the fin of FIG. 4D, illustrating tab cuts in the tab.

DETAILED DESCRIPTION OF THE PREFERRED EMBODIMENTS

Figure 1:
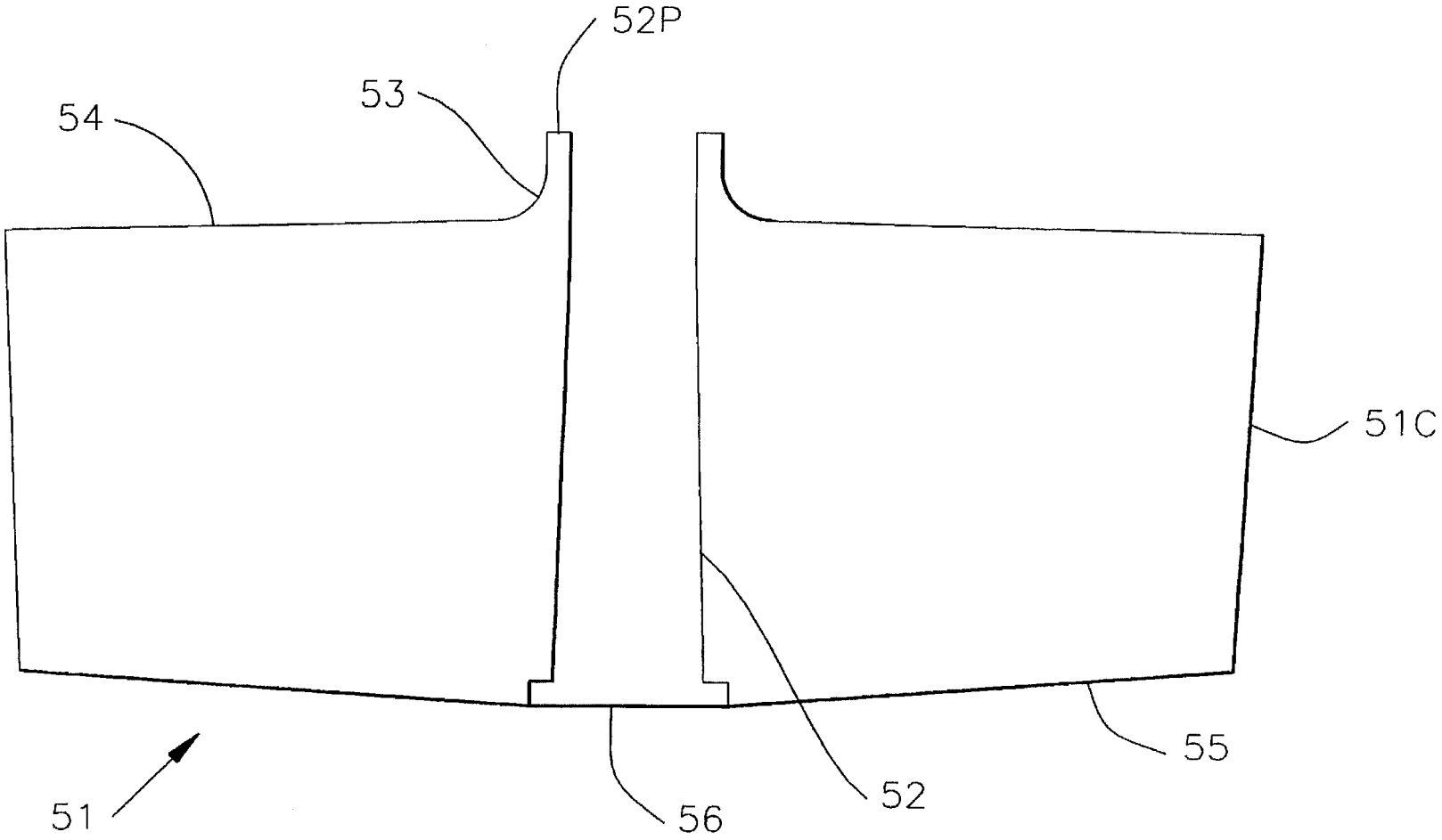
FIG. 1 is a cross sectional view of one embodiment of a plug or the like, adapted to be disposed within a surfboard, allowing releasable attachment of a fin to the surfboard.

FIG. 1 illustrates a plug 51 which is adapted to be fixedly disposed within a surfboard or other aquafoil device. The plug 51 may also be referred to as a fin box. The plug 51 is of substantially cylindrical shape, with a substantially round cross section, and a circumference or periphery 51C. The plug 51 has a top surface 54, a lower surface 55, a flat base 56, and an elongated central slot 52 having an opening 52P in the top surface 54, the central slot 52 substantially rectangular in shape at the opening 52P. The central slot 52 has a reverse taper, flaring wider toward the flat base 56. The plug 51 has a substantially centrally disposed lip 53 protruding above the top surface 54 thereof, around the central slot 52.

Preferably, both the top surface 54 and lower surface 55 of the plug 51 are substantially convex in shape, sloping slightly toward each other, toward the circumference of the plug 51. Preferably, this sloping is at an angle of five degrees, which is critical to setting dual rail fins that extend from the side of a typical surfboard. The plug 51 is thus capable of serving several functions, by providing the correct angle of each side fin, as well as providing the ninety degree setting for the tail fin which is set to the flat base 56 of the plug 51 below the central slot 52.

Figure 2:
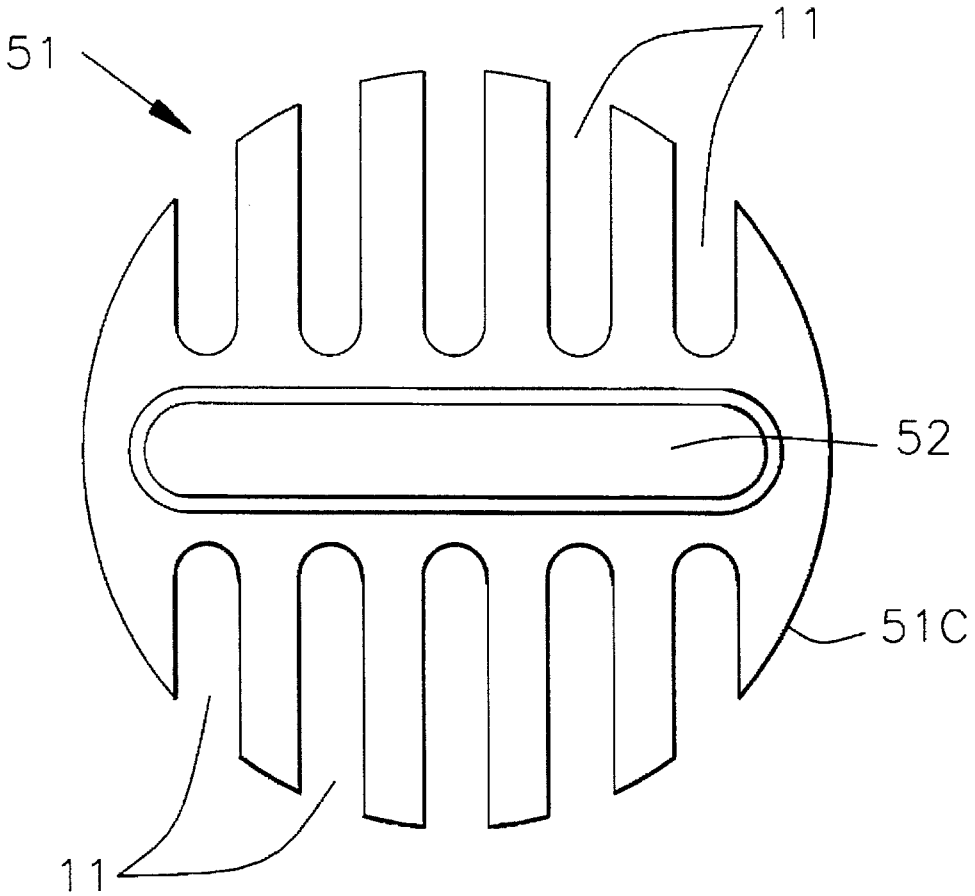
FIG. 2 is a top plan view of a preferred embodiment of the plug.
Figure 3:
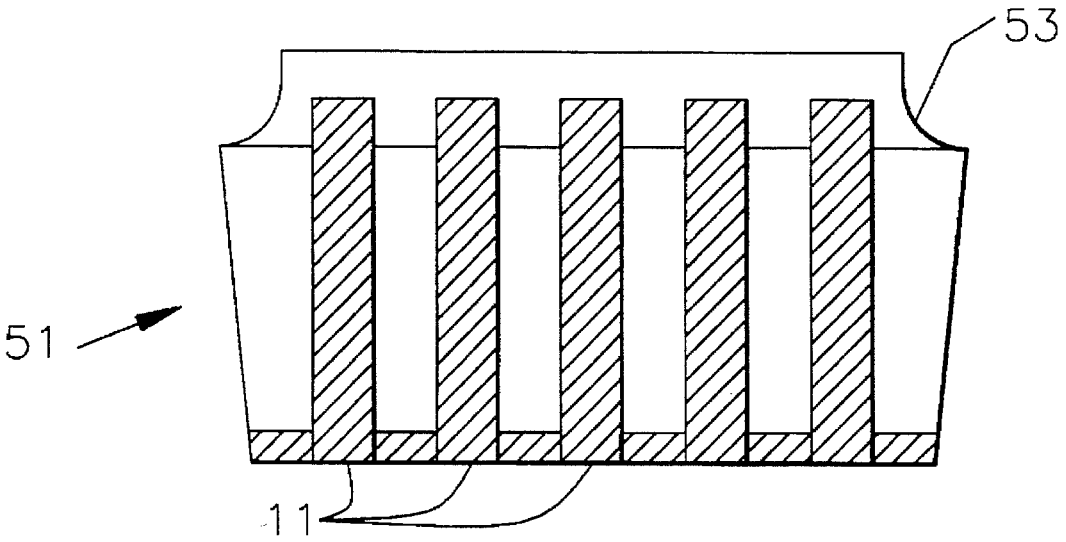
FIG. 3 is a side elevational view of the plug.

Referring now to FIG. 2 and FIG. 3, the plug 51 can include a plurality of plug cuts 11 extending from the periphery of the plug 51 toward the central slot 52, the plug cuts 11 extending substantially perpendicular to the central slot 52. Alternatively, in an embodiment not illustrated, the plug cuts 11 may extend radially toward the periphery. The purpose of the plug cuts 11 is to aid proper affixation of the plug 51 in the surfboard.

In order to attach the plug 51 in a surfboard, a bore or hole resembling the plug 51 in shape and size must first be made. The plug 51 is then inserted within that bore or hole. A bonding material is then applied over the entire surface of the board to bond the plug 51 to the board and within the board. The plug cuts 11 assist the bonding by allowing the bonding material to flow into the plug cuts and greatly increase the surface area for bonding.

During the bonding, the lip 53 protrudes above the applied bonding material, to form a wall or barrier which prevents the bonding material from seeping or overflowing into the central slots 52 during the bonding operation. After the bonding material has cured, the protruding lip 53 can be sanded to ensure that the outermost surface of the board, with the plug 51 disposed therewithin, is substantially smooth and includes no discontinuities. The result is that the plug is rigidly disposed within the board, with the central slot 52 being exposed for the purposes of receiving a fin 20 of the type illustrated in FIG. 4A–4G.

Figure 4A:
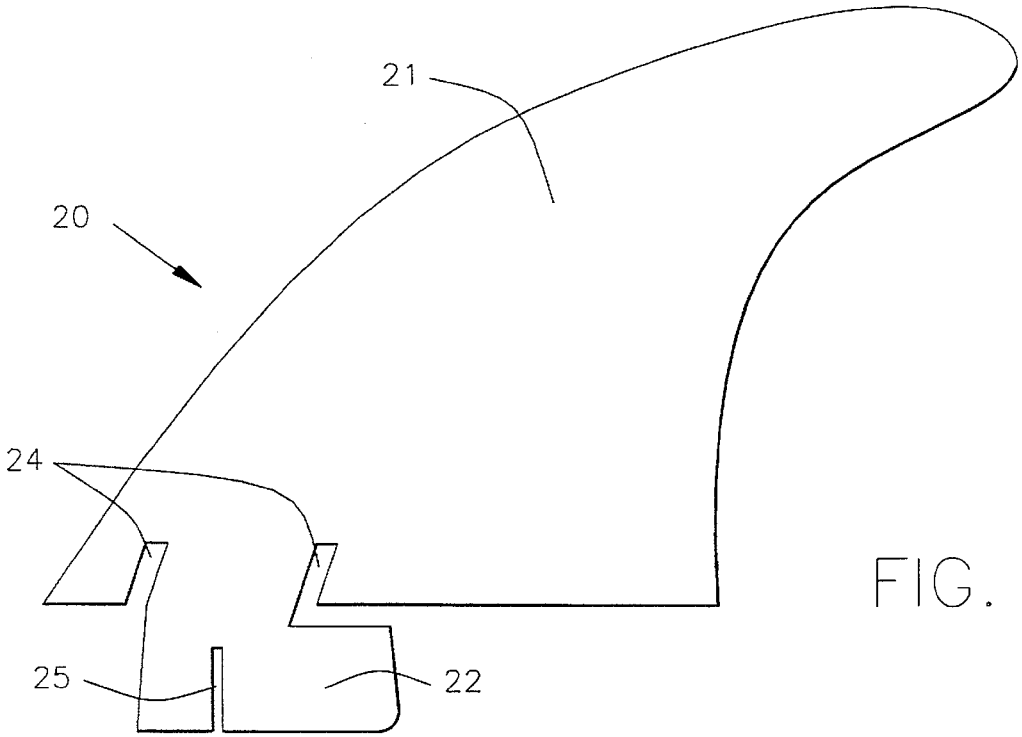
FIG. 4A, 4B, and 4C are side elevational views of preferred fin structures for use in accordance with the present invention.
Figure 4B:
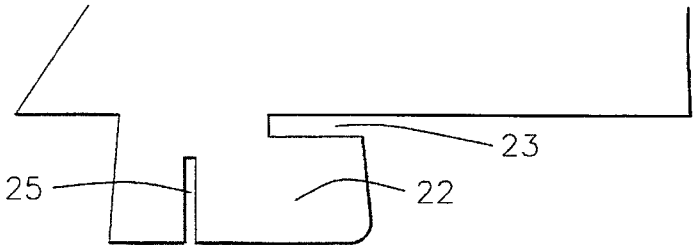
Figure 4C:
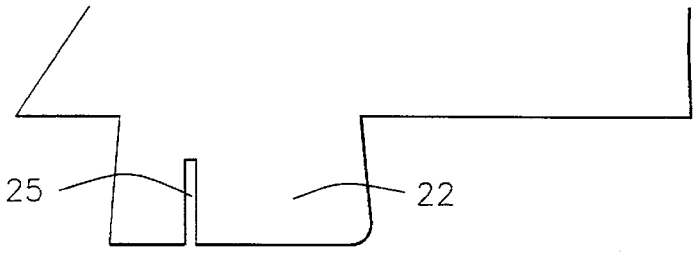

Referring now to FIG. 4A, 4B, and 4C, several embodiments for the fin 20 are illustrated, which may be used in conjunction with the plug 51 previously described. The different fins may be selected by the surfboard rider according to prevailing surf conditions and the rider's preferences, to obtain optimum control of the board.

The fin 20 has a main portion 21 having a hydrodynamic shape, making it suitable for use protruding downwardly from a surfboard near its rear. The fin 20 has a tab 22 cooperable with the central slot 52 of the plug 51, wherein the tab 22 is selectively affixable in and removable from the central slot 52. Preferably the main portion 21 and tab 22 are integrally made, molded or hand crafted from a continuous piece of material.

Referring to FIG. 4D and 4G simultaneously, the tab 22 is flared, being wider near its base 22B, opposite the main portion 21, and tapered inward toward the main portion 21 of the fin 20. The taper of the tab 22 matches the taper in the central slot 52 of the plug 51. The tab, as illustrated in FIG. 4G, is divided with a transverse vertical slot 25 and a longitudinal vertical slot 26. These two vertical slots extend into the tab 22 at its base 22B opposite the main portion 21, and are perpendicular to each other.

Figure 4E:
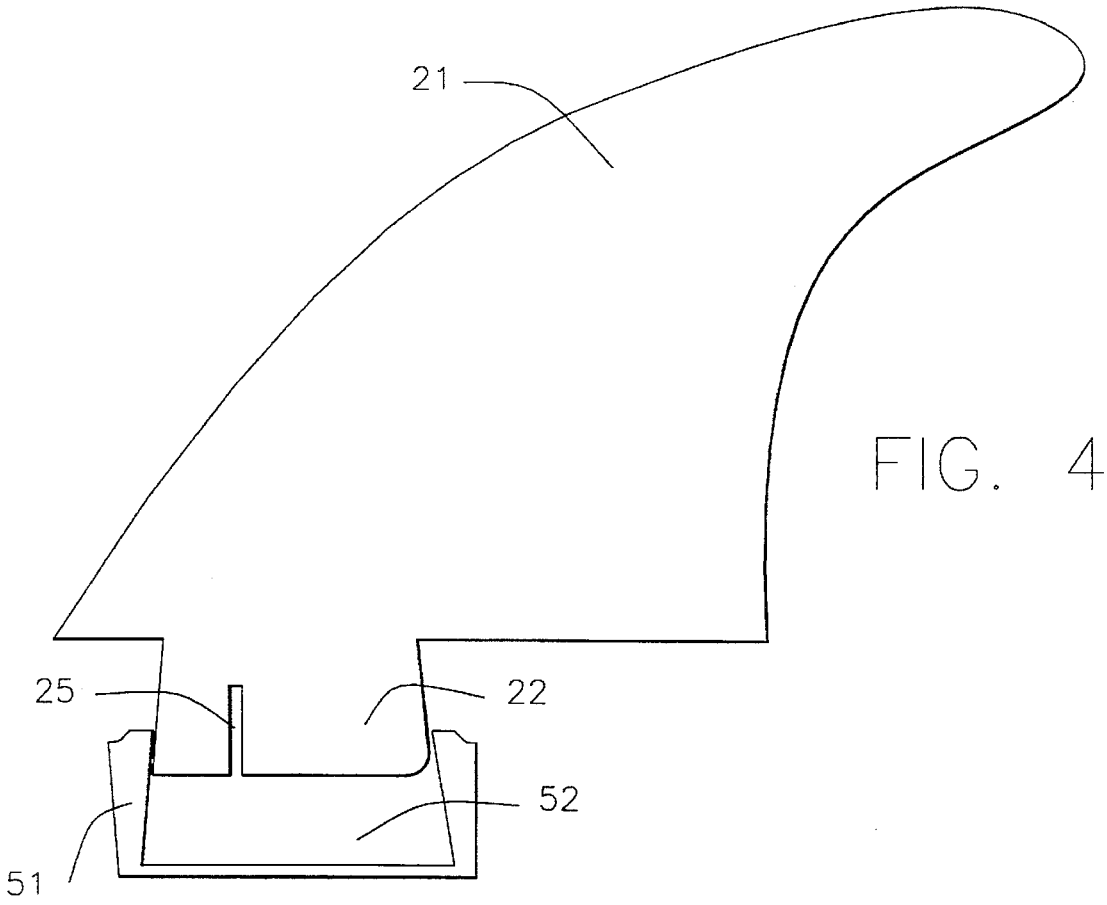
FIG. 4E is a side elevational view of the fin about to be inserted into the plug.
Figure 4F:
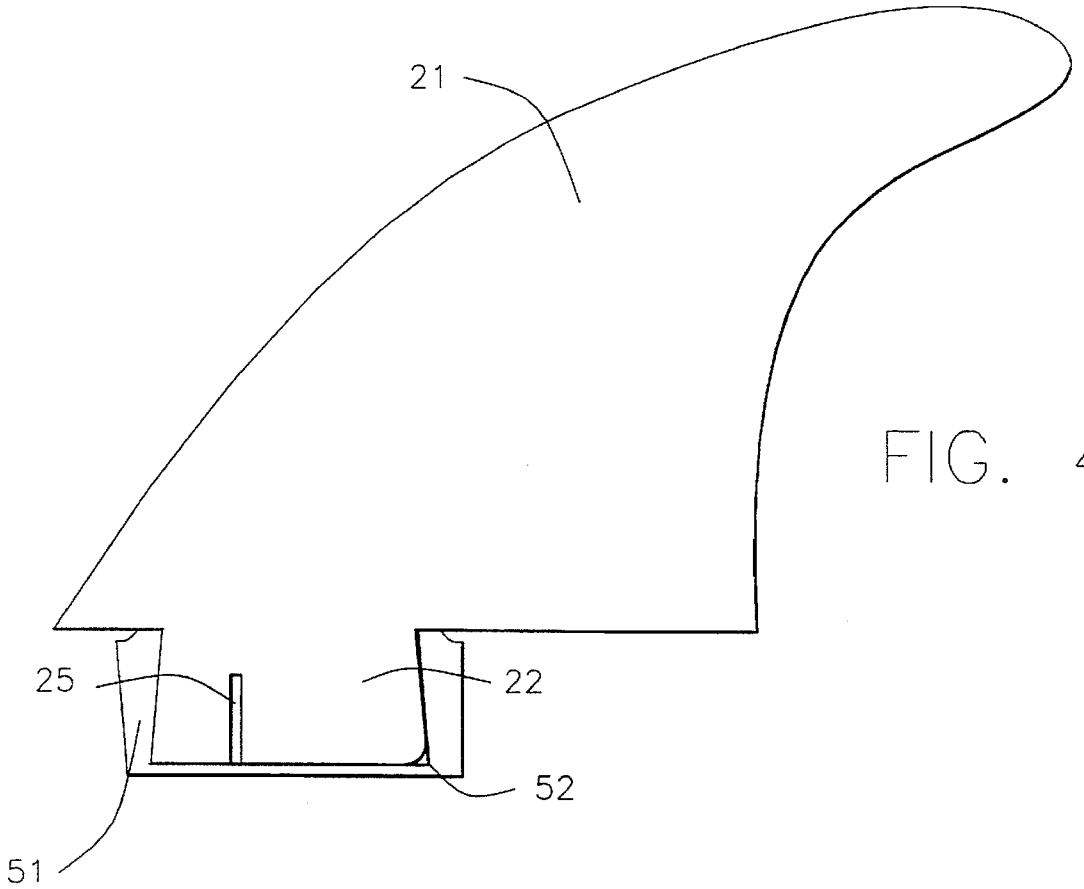
FIG. 4F is a side elevational view of the fin fully inserted into the plug.

The purpose of the two vertical slots is to allow the fin 20 to easily, yet securely attach to the plug 51. Referring to FIG. 4E, when the tab 22 of the fin 20 is pushed into the central slot 52 of the plug 51, the transverse vertical slot 25 and longitudinal vertical slot 26 compress or close together, allowing the wider base of the tab 22 to pass into the taper of the central slot 52 of the plug 51. As the fin 20 is forced deeper into the plug, the transverse vertical slot 25 and longitudinal vertical slot 26 are allowed to once again expand and return to their open positions, wedging or locking the tab 22 into the central slot 52 by means of the reverse taper of both the tab 22 and central slot 52. Thus, the fin 20 is securely locked to the surfboard.

Once attached to the surfboard as described above, the fin 20 may only be removed by being firmly pulled perpendicular to the board. However, when the surfboard or aquafoil is in the water or traveling over the water, the fin never encounters a force which would tend to pull the fin 20 perpendicular to the surfboard or aquafoil. Therefore, by the system described herein, the fin 20 may only be intentionally removed from the plug 51, and will never be accidentally released from the plug 51 during use.

Referring to FIG. 4A thru 4C, illustrated are variations of the fin 20 which may be used depending on the prevailing surf and wind conditions. In addition to variations in the hydrodynamic contour of the main portion 21, the attachment of the main portion 21 to the tab 22 may also be varied to alter the flexibility of the fin 20, by allowing varying degrees of arc which allow increased pivotability, and cause the fin 20 to be self-aligning, to compensate for the effects of cavitation which tend to slow the surfboard or aquafoil.

FIG. 4C illustrates a solid tab configuration for the fin 20. The solid tab configuration provides the least fin pivotability. FIG. 4B illustrates an embodiment having a horizontal tab cut 23, which in effect reduces the material joining the tab 22 and main portion 21, thus allowing greater pivotability than the solid tab embodiment. FIG. 4A illustrates an embodiment having dual vertical tab cuts 24, which allow considerable pivotability of the main portion 21 with respect to the tab 22. The tab cuts illustrated in FIG 4B and 4C create a torsion bar effect which affords complete flexibility for the fin once disposed on the board, by allowing the fin to pivot at least to some extent from the base of the board, this is markedly contrary to prior art rigid fins. Thus, the rider is afforded a greater degree of control. The arrangement is such that the fin, when installed in the board, is capable of a change in direction, pivoting or swiveling to some extent, about an axis perpendicular or normal to the board. The leading edge of the fin thus changes its angle relative to the board when under pressure, increasing speed through turns by reducing the extent and effect of "drag" associated with rigid type fins.

What is claimed is:

1. A pivotable fin system, for use with an aquafoil such as a surfboard, comprising:

a plug, the plug installing within the aquafoil, the plug having a central slot having an opening, the plug having a base, the central slot has a reverse taper, the reverse taper flaring from the opening and becoming wider toward the base; and a fin having a main portion and a tab, the main portion joined to the tab, the tab flared away from the main portion to match the reverse taper of the central slot, the tab having at least one vertical slot, wherein the fin has at least one tab cut where the main portion adjoins the tab to provide pivotability of the main portion with respect to the tab.

2. The pivotable fin system as recited in claim 1, wherein the cut is a horizontal tab cut.

3. The pivotable fin system as recited in claim 1, wherein the tab cut is dual vertical tab cuts.

4. A pivotable fin system, for use with an aquafoil such as a surfboard, comprising:

a plug, the plug installing within the aquafoil, the plug having a central slot having an opening, the plug having a base, the central slot has a reverse taper, the reverse taper flaring from the opening and becoming wider toward the base wherein the plug is substantially cylindrical in shape, having a top surface, a lower surface, a circumference and a protruding lip extending from the top surface surrounding the central slot, wherein the top surface and lower surface taper toward each other toward the circumference; and a fin having a main portion and a tab, the main portion joined to the tab, the tab flared away from the main portion to match the reverse taper of the central slot, the tab having at least one vertical slot.

5. The pivotable fin system as recited in claim 4, wherein the plug further comprises a plurality of plug cuts, extending from the circumference toward the central slot.

6. The pivotable fin system as recited in claim 5, wherein the at least one vertical slot further comprises a transverse vertical slot and a longitudinal vertical slot.

* * * * *